US011603574B2

(12) United States Patent
Hirashima et al.

(10) Patent No.: US 11,603,574 B2
(45) Date of Patent: Mar. 14, 2023

(54) HIGH-DUCTILITY HIGH-STRENGTH STEEL SHEET AND METHOD FOR PRODUCING THE SAME

(71) Applicant: JFE STEEL CORPORATION, Tokyo (JP)

(72) Inventors: Takuya Hirashima, Tokyo (JP); Yoshihiko Ono, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 118 days.

(21) Appl. No.: 16/964,651

(22) PCT Filed: Jan. 24, 2019

(86) PCT No.: PCT/JP2019/002231

§ 371 (c)(1),
(2) Date: Jul. 24, 2020

(87) PCT Pub. No.: WO2019/146683

PCT Pub. Date: Aug. 1, 2019

(65) Prior Publication Data

US 2021/0054478 A1 Feb. 25, 2021

(30) Foreign Application Priority Data

Jan. 26, 2018 (JP) ..... JP2018-011098

(51) Int. Cl.

| | |
|---|---|
| ***C21D 9/46*** | (2006.01) |
| ***C21D 1/26*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |

(52) U.S. Cl.

CPC ..... *C21D 9/46* (2013.01); *C21D 1/26* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C21D 1/26; C21D 2211/001; C21D 2211/002; C21D 2211/005; C21D 2211/008; C21D 2211/009; C21D 6/005; C21D 6/008; C21D 8/0205; C21D 8/0226; C21D 8/0236; C21D 8/0263; C21D 8/0273; C21D 9/46; C22C 38/001; C22C 38/002; C22C 38/005; C22C 38/02; C22C 38/04; C22C 38/06; C22C 38/08; C22C 38/12; C22C 38/14; C22C 38/16; C22C 38/18; C22C 38/54; C23C 2/02

See application file for complete search history.

(56) References Cited

U.S. PATENT DOCUMENTS

2014/0220383 A1* 8/2014 Kariya ..... C22C 38/18 148/533

FOREIGN PATENT DOCUMENTS

| | | | |
|---|---|---|---|
| CN | 107148487 | A | 9/2017 |
| EP | 2 290 111 | A1 | 3/2011 |
| EP | 2 530 179 | A1 | 12/2012 |
| EP | 2 589 677 | A1 | 5/2013 |
| EP | 2952600 | A1 | 12/2015 |
| EP | 3 216 886 | A1 | 9/2017 |
| JP | H08-295985 | A | 11/1996 |
| JP | 2002-235145 | A | 8/2002 |
| JP | 2007-107099 | A | 4/2007 |
| JP | 2011-017046 | A | 1/2011 |
| JP | 2013-36069 | A | 2/2013 |
| JP | 2013-36071 | A | 2/2013 |

(Continued)

OTHER PUBLICATIONS

Mar. 19, 2019 International Search Report issued in International Patent Application No. PCT/JP2019/002231.

(Continued)

*Primary Examiner* — Jenny R Wu
(74) *Attorney, Agent, or Firm* — Oliff PLC

(57) ABSTRACT

A high-ductility, high-strength steel sheet having excellent close-contact bendability and a method for producing the same. The steel sheet has a specified chemical composition and a microstructure comprising, by area percentage, 50% or more of a ferrite phase, 5% to 30% of a pearlite phase, and 15% or less in total of bainite, martensite, and retained austenite, in which the area percentage of ferrite grains each containing three or more cementite grains having an aspect ratio of 1.5 or less is 30% or less, and the number of inclusions having a particle size of 10 μm or more present in a portion extending from a surface to a ¼ thickness position is 2.0 particles/mm$^2$ or less.

28 Claims, 1 Drawing Sheet

(56) References Cited

FOREIGN PATENT DOCUMENTS

| | | | |
|---|---|---|---|
| JP | 2014-031560 | A | 2/2014 |
| JP | 2014-208884 | A | 11/2014 |
| KR | 2012-0096109 | A | 8/2012 |
| KR | 2013-0021407 | A | 3/2013 |
| WO | 2017/169941 | A1 | 10/2017 |

OTHER PUBLICATIONS

Mar. 31, 2021 Office Action issued in Chinese Patent Application No. 201980009954.X.
Sep. 30, 2020 Extended Search Report issued in European Patent Application No. 19743740.3.
Mar. 29, 2022 Notice of Allowance issued in Korean Patent Application No. 10-2020-7021530.

* cited by examiner

HIGH-DUCTILITY HIGH-STRENGTH STEEL SHEET AND METHOD FOR PRODUCING THE SAME

TECHNICAL FIELD

This application relates to a high-ductility high-strength steel sheet excellent in close-contact bendability and suitable for use in automotive components and so forth, and a production method thereof.

BACKGROUND

In recent years, attempts have been made to reduce exhaust gases, such as $CO_2$, in view of global environmental protection. In the automotive industry, measures have been taken to reduce the amounts of exhaust gases by reducing the weight of automobile bodies to improve fuel efficiency. An example of techniques for reducing the weight of automobile bodies is a technique in which the increased strength of steel sheets used for automobiles enables a reduction in the thickness of the steel sheet. It is known that the ductility of steel sheets decreases with increasing strength of steel sheets. There is a demand for a steel sheet having both of high strength and ductility. Additionally, components around floors often have complicated shapes obtained by forming. There is a demand for a steel sheet that does not crack during close-contact bending for which press-forming is performed after bend-forming.

To address such demands, for example, Patent Literature 1 discloses, as a method for producing a cold-rolled steel sheet having excellent workability, a method in which a cold-rolled steel sheet is heated and held in a ferrite-austenite two-phase region and cooled to form fine ferrite, the remainder being pearlite or bainite microstructure.

Patent Literature 2 discloses, as a method for producing a high-strength hot-dip galvanized steel sheet having excellent workability, a method by which a high-strength hot-dip galvanized steel sheet having excellent workability is produced by, after annealing and soaking, specifying an average cooling rate from 650° C. to when a steel sheet enters a molten zinc bath or to 300° C. and holding the steel sheet at a temperature in a temperature range of 300° C. or lower for a predetermined period of time before hot-dip galvanizing to form a steel microstructure composed of ferrite and pearlite and by appropriately controlling the amount of cementite in grains of the ferrite phase.

Patent Literature 3 discloses a high-strength steel sheet having excellent close-contact bendability, having a component composition adjusted to an appropriate range, and having a uniform steel microstructure composed of bainitic ferrite or bainite to reduce the interfaces between soft layers and hard layers, the interfaces easily serving as starting points of cracks. The suppressing generation of the starting points of cracks enables the suppression of the occurrence of cracks from an end face during bending.

CITATION LIST

Patent Literature

PTL 1: Japanese Unexamined Patent Application Publication No. 2007-107099

PTL 2: Japanese Unexamined Patent Application Publication No. 2013-36071

PTL 3: Japanese Unexamined Patent Application Publication No. 08-295985

SUMMARY

Technical Problem

The technique described in Patent Literature 1 has excellent workability because of its small grain size but problematically has inferior close-contact bendability.

The technique described in Patent Literature 2 problematically has inferior close-contact bendability because cementite acts as a starting point of void formation.

In the technique described in Patent Literature 3, the elongation is about 10%, and the ductility is not considered at all.

The disclosed embodiments have been accomplished in light of the above circumstances and aims to provide a high-ductility high-strength steel sheet having excellent close-contact bendability and a production method thereof.

Solution to Problem

The inventors have conducted intensive studies from the viewpoints of a component composition and a steel structure and have found that it is significantly important to adjust the component composition to an appropriate range and to appropriately control the steel microstructure. Specifically, the inventors have found that it is possible to achieve high strength, close-contact bendability, and high ductility by adjusting the component composition to a specific component composition and obtaining a steel microstructure that contains, by an area percentage, 50% or more of a ferrite phase, 5% to 30% of a pearlite phase, and 15% or less in total of bainite, martensite, and retained austenite, in which the area percentage of ferrite grains each containing three or more cementite grains having an aspect ratio of 1.5 or less is 30% or less, and the number of inclusions having a particle size of 10 μm or more present in a portion extending from a surface to a ¼ thickness position is 2.0 particles/$mm^2$ or less.

As a steel microstructure for obtaining high ductility, a dual-phase microstructure composed of a ferrite phase and a martensite phase is preferred. However, because of the large difference in hardness between the ferrite phase and the martensite phase, this dual-phase microstructure serves as a starting point of void formation, thus failing to obtain good close-contact bendability.

In contrast, the inventors have specified the component composition and the steel microstructure to enable the steel sheet with a dual-phase microstructure containing a ferrite phase and a pearlite phase to have a high tensile strength of 370 MPa or more, ductility, and close-contact bendability as described above. That is, the inventors have specified the area percentage of the ferrite phase as a steel microstructure to ensure the strength and the ductility, and have appropriately controlled the area percentage of the pearlite phase as a second phase to ensure the strength. Furthermore, the suppression of the formation of coarse inclusions present in a portion extending from a surface to a ¼ thickness position have enabled the acquisition of high ductility and high strength with good close-contact bendability ensured.

The disclosed embodiments are based on the aforementioned findings and have the features as listed below.

[1] A high-ductility high-strength steel sheet having a component composition containing, on a percent by mass basis, C: 0.100% to 0.250%, Si: 0.001% to 1.0%, Mn: 0.75% or less, P: 0.100% or less, S: 0.0150% or less, Al: 0.010% to 0.100%, and N: 0.0100% or less, the balance being Fe and incidental impurities, and a steel microstructure containing, by an area percentage, 50% or more of a ferrite phase, 5% to 30% of a pearlite phase, and 15% or less in total of bainite, martensite, and retained austenite, in which the area percentage of ferrite grains each containing three or more cementite grains having an aspect ratio of 1.5 or less is 30% or less, and the number of inclusions having a particle size of 10 μm or more present in a portion extending from a surface to a ¼ thickness position is 2.0 particles/$mm^2$ or less.

[2] In the high-ductility high-strength steel sheet described in [1], the component composition further containing, on a percent by mass basis, one or more elements selected from Cr: 0.001% to 0.050%, V: 0.001% to 0.050%, Mo: 0.001% to 0.050%, Cu: 0.005% to 0.100%, Ni: 0.005% to 0.100%, and B: 0.0003% to 0.2000%.

[3] In the high-ductility high-strength steel sheet described in [1] or [2], the component composition further containing, on a percent by mass basis, one or more elements selected from Ca: 0.0010% to 0.0050% and REM: 0.0010% to 0.0050%.

[4] In the high-ductility high-strength steel sheet described in any one of [1] to [3], the high-ductility high-strength steel sheet including a coated layer on a surface thereof.

[5] In the high-ductility high-strength steel sheet described in [4], the coated layer being a hot-dip galvanized layer, a hot-dip galvannealed layer, or an electrogalvanized layer.

[6] A method for producing a high-ductility high-strength steel sheet including a hot-rolling step of performing hot-rolling a steel having the component composition described in any one of [1] to [3] under condition that an average cooling rate after continuous casting is 0.5° C./s or more and a residence time in a temperature range of 1,150° C. or higher is 2,000 to 3,000 seconds, and performing coiling at a coiling temperature of 600° C. or lower; a pickling step of pickling a steel sheet after the hot-rolling step; and an annealing step of heating the steel sheet after the pickling step to (Ac1+20°) C. or higher under condition that an average heating rate to 400° C. is 2.0° C./s or more, holding the steel sheet in a temperature range of (Ac1+20°) C. or higher for 10 seconds or more and 300 seconds or less, cooling the steel sheet to 550° C. or lower under condition that an average cooling rate to 550° C. after the holding is 10 to 200° C./s, holding the steel sheet in a temperature range of 350° C. or higher and 550° C. or lower for 30 to 800 seconds, and cooling the steel sheet under condition that an average cooling rate is 2.0° C./s or more and 5.0° C./s or less in a temperature range to 200° C. after the holding.

[7] A method for producing a high-ductility high-strength steel sheet including a hot-rolling step of performing hot-rolling a steel having the component composition described in any one of [1] to [3] under conditions that an average cooling rate after continuous casting is 0.5° C./s or more and a residence time in a temperature range of 1,150° C. or higher is 2,000 to 3,000 seconds, and performing coiling at a coiling temperature of 600° C. or lower; a pickling step of pickling a steel sheet after the hot-rolling step; a cold-rolling step of cold-rolling the steel sheet after the pickling step; and an annealing step of heating the steel sheet after the cold-rolling step to (Ac1+20°) C. or higher under condition that an average heating rate to 400° C. is 2.0° C./s or more, holding the steel sheet in a temperature range of (Ac1+20°) C. or higher for 10 seconds or more and 300 seconds or less, cooling the steel sheet to 550° C. or lower under condition that an average cooling rate to 550° C. after the holding is 10 to 200° C./s, holding the steel sheet in a temperature range of 350° C. or higher and 550° C. or lower for 30 to 800 seconds, and cooling the steel sheet under condition that an average cooling rate is 2.0° C./s or more and 5.0° C./s or less in a temperature range to 200° C. after the holding.

[8] In the method for producing a high-ductility high-strength steel sheet described in [6] or [7], after the holding of the steel sheet in the temperature range of 350° C. or higher and 550° C. or lower for 30 to 800 seconds in the annealing step, the steel sheet being subjected to coating treatment.

Advantageous Effects

According to the disclosed embodiments, the high-ductility high-strength steel sheet having excellent close-contact bendability is obtained. Since the high-ductility high-strength steel sheet of the disclosed embodiments has excellent close-contact bendability, for example, the use of the steel sheet for automotive structural members makes it possible to achieve a reduction in the weight of automobile bodies to contribute to an improvement in fuel economy; thus, the high-ductility high-strength steel sheet has a very high industrial utility value.

DETAILED DESCRIPTION

Figure 1:
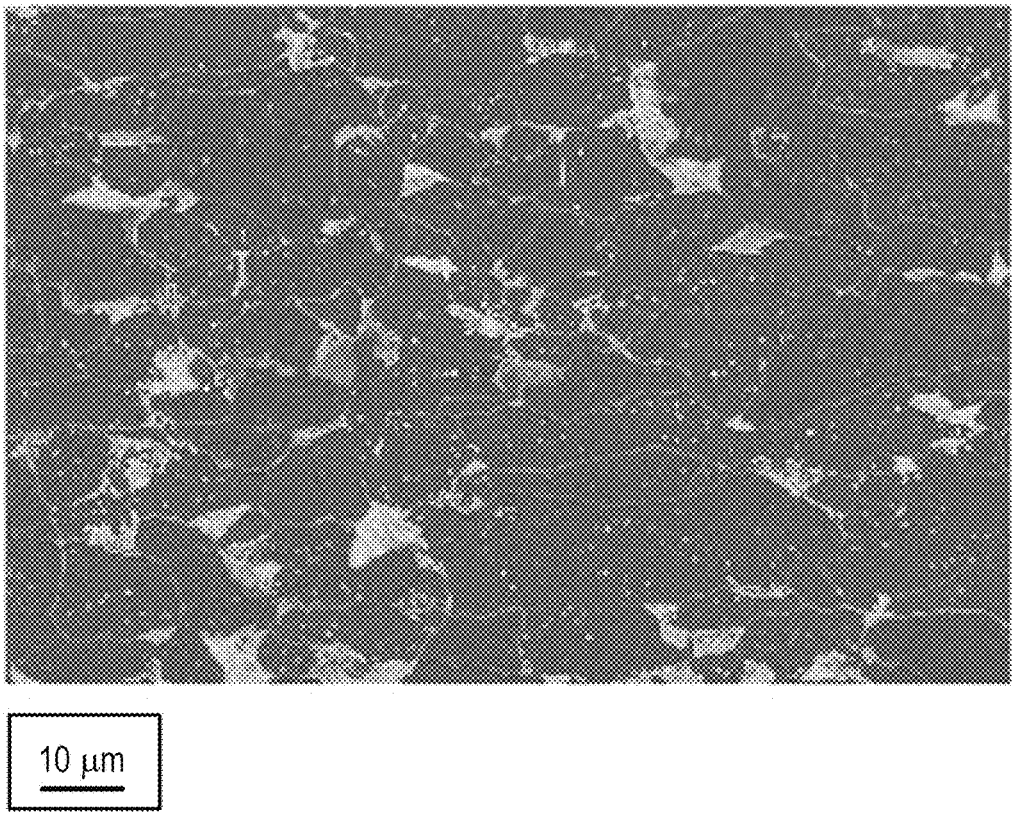
FIG. 1 illustrates an example of a SEM image of a comparative example.

Disclosed embodiments will be described below. It will be understood that the disclosure is not limited to these embodiments.

The component composition of a high-ductility high-strength steel sheet of the disclosed embodiments (hereinafter, also referred to as a "steel sheet of the disclosed embodiments") will be described. In the description of the component composition, each content of component elements is expressed in units of "%" that refers to "% by mass".

C: 0.100% to 0.250%

C is an essential element to ensure desired strength and provide a complex phase microstructure to improve the strength and the ductility. To provide the effects, the C content needs to be 0.100% or more. The C content is preferably 0.120% or more, more preferably 0.140% or more. At a C content of more than 0.250%, the strength is significantly increased and desired ductility cannot be obtained. At a C content of more than 0.250%, the strength of pearlite is increased to increase the difference in hardness between ferrite and pearlite. Furthermore, the formation of cementite is also promoted. Thereby, the close-contact bendability is deteriorated. Accordingly, the C content is 0.250% or less. The C content is preferably 0.220% or less, more preferably 0.200% or less.

Si: 0.001% to 1.0%

Si is a useful element because Si contributes to form a ferrite phase and strengthens steel. Si suppresses the formation of coarse carbide to contribute to an improvement in the close-contact bendability. Thus, the Si content is 0.001% or more. The Si content is preferably 0.005% or more, more preferably 0.010% or more. A Si content of more than 1.0% results in the formation of coarse carbide, thereby deteriorating the close-contact bendability. Accordingly, the Si content is 1.0% or less. The Si content is preferably 0.8% or less, more preferably 0.6% or less. The lower limit of the Si content is a value that provides desired strength and elongation.

Mn: 0.75% or less

As with C, Mn is an essential element to ensure desired strength and stabilizes an austenite phase to promote the formation of a pearlite phase. Mn also contributes to ensuring strength. For example, when desired strength is ensured by another configuration, the Mn content may be low. To produce the above effects, the Mn content is preferably 0.10% or more, more preferably 0.20% or more, even more preferably 0.25% or more. A Mn content of more than 0.75% results in an excessively large area percentage of pearlite, thereby decreasing the ductility. Additionally, Mn is an element that particularly promotes the formation and coarsening of MnS, thus deteriorating the close-contact bendability. Accordingly, the Mn content is 0.75% or less. The Mn content is preferably 0.72% or less, more preferably 0.70% or less.

P: 0.100% or less

P is an element effective in strengthening steel. At a P content of more than 0.100%, however, embrittlement is caused by grain boundary segregation to deteriorate the close-contact bendability. Accordingly, the P content is 0.100% or less. The P content is preferably 0.080% or less, more preferably 0.050% or less. The lower limit of the P content is not particularly limited. The industrially feasible lower limit thereof is about 0.001% at present.

S: 0.0150% or less

S is formed into non-metallic inclusions, such as MnS. The non-metallic inclusions promote the formation of voids to deteriorate the close-contact bendability. The S content is desirably as small as possible and the S content is 0.0150% or less. The S content is preferably 0.0120% or less, more preferably 0.0100% or less. The lower limit of the S content is not particularly limited. The industrially feasible lower limit thereof is about 0.0002% at present.

Al: 0.010% to 0.100%

Al is contained in an amount of 0.010% or more in order to deoxidize steel and reduce the amounts of coarse inclusions in steel. The Al content is preferably 0.015% or more, more preferably 0.020% or more. An Al content of more than 0.100% results in the formation of AlN to promote void formation, thereby deteriorating the close-contact bendability. Accordingly, the Al content is 0.100% or less. The Al content is preferably 0.080% or less, more preferably 0.060% or less.

N: 0.0100% or less

N does not impair the advantageous effects of the disclosed embodiments as long as a N content is 0.0100% or less, which is the N content of ordinary steel. A N content is more than 0.0100% results in the formation of AlN to deteriorate the close-contact bendability. Accordingly, the N content is 0.0100% or less. The N content is preferably 0.0080% or less, more preferably 0.0060% or less. The lower limit of the N content is not particularly limited. The industrially feasible lower limit thereof is about 0.0006% at present.

The component composition of the steel sheet of the disclosed embodiments may further contain, on a percent by mass basis, one or more elements selected from Cr: 0.001% to 0.050%, V: 0.001% to 0.050%, Mo: 0.001% to 0.050%, Cu: 0.005% to 0.100%, Ni: 0.005% to 0.100%, and B: 0.0003% to 0.2000% as optional elements.

Cr and V can be added for the purposes of improving the hardenability of steel and increasing the strength. From the viewpoint of producing the effects, any of Cr and V may be contained in an amount of 0.001% or more. The amount of any of Cr and V contained is preferably 0.005% or more, more preferably 0.010% or more. When the amount of any of Cr and V contained is 0.050% or less, the amounts of coarse inclusions and the amount of cementite are not excessive; thus, desired close-contact bendability is obtained. The amount of any of Cr and V contained is preferably 0.045% or less, more preferably 0.040% or less.

Mo is an element effective in increasing the hardenability of steel and can be added for the purpose of increasing the strength. From the viewpoint of providing the effects, Mo may be contained in an amount of 0.001% or more. The Mo content is preferably 0.003% or more, more preferably 0.005% or more. When the Mo content is 0.050% or less, the amounts of coarse inclusions and the amount of cementite are not excessive; thus, desired close-contact bendability is obtained. The Mo content is preferably 0.040% or less, more preferably 0.030% or less.

Cu and Ni are elements that contribute to strength and can be added for the purpose of increasing the strength of steel. From the viewpoint of producing the effect, any of Cu and Ni elements may be contained in an amount of 0.005% or more. The amount of any of Cu and Ni elements contained is preferably 0.010% or more, more preferably 0.020% or more. When any of Cu and Ni elements contained is 0.100% or less, the amounts of coarse inclusions and the amount of cementite are not excessive; thus, desired close-contact bendability is obtained. The amount of any of Cu and Ni elements contained is preferably 0.080% or less, more preferably 0.060% or less.

B has an effect of suppressing the formation of ferrite starting from austenite grain boundaries and thus can be added as needed. For the purpose of producing the effect, B may be contained in an amount of 0.0003% or more. The B content is preferably 0.0005% or more, more preferably 0.0010% or more. When the B content is 0.2000% or less, the amounts of coarse inclusions and the amount of cementite are not excessive; thus, desired close-contact bendability is obtained. The B content is preferably 0.1000% or less, more preferably 0.0100% or less.

The component composition of the steel sheet of the disclosed embodiments may contain, on a percent by mass basis, one or more elements selected from Ca: 0.0010% to 0.0050% and REM: 0.0010% to 0.0050% as optional elements.

Ca and REM can be added for the purposes of deoxidization and desulfurization of steel. For the purpose of producing the effects, any of Ca and REM elements may be contained in an amount of 0.0010% or more. The amount of any of Ca and REM elements contained is preferably 0.0015% or more, more preferably 0.0020% or more. When the amount of any of Ca and REM elements contained is 0.0050% or less, sulfide is not excessively precipitated, thus obtaining desired close-contact bendability. Accordingly, the amount of any of Ca and REM elements contained is 0.0050% or less. The amount of any of Ca and REM elements contained is preferably 0.0040% or less.

The remainder other than the above is Fe and incidental impurities. When any of the above optional elements is contained in an amount of less than the lower limit, the element shall be contained as an incidental impurity.

The steel microstructure of the steel sheet of the disclosed embodiments will be described below. The steel microstructure of the steel sheet of the disclosed embodiments contains, by an area percentage, 50% or more of a ferrite phase, 5% to 30% of a pearlite phase, 15% or less in total of bainite, martensite, and retained austenite, in which the area percentage of ferrite grains each containing three or more cementite grains having an aspect ratio of 1.5 or less is 30% or less, and the number of inclusions having a particle size of 10 μm or more present in a portion extending from a surface to a ¼ thickness position is 2.0 particles/mm$^2$ or less. As the area percentages of each structure in the steel microstructure and the number density of the inclusions, values determined by measurement methods described in examples are used.

Area Percentage of Ferrite Phase: 50% or More

To ensure ductility, the area percentage of the ferrite phase needs to be 50% or more. The area percentage of the ferrite phase is preferably 55% or more, more preferably 60% or more, particularly preferably 70% or more. The area percentage of the ferrite phase is preferably 95% or less, more preferably 90% or less, even more preferably 88% or less.

Area Percentage of Pearlite Phase: 5% to 30%

To ensure strength and reduce the difference in hardness between the ferrite phase and the pearlite phase to obtain good close-contact bendability, the area percentage of the pearlite phase needs to be 5% or more. The area percentage of the pearlite phase is preferably 7% or more, more preferably 9% or more. When the area percentage of the pearlite phase is more than 30%, the strength is excessively increased and desired ductility cannot be obtained. Thus, the area percentage of the pearlite phase is 30% or less. The area percentage of the pearlite phase is preferably 28% or less, more preferably 26% or less.

Total Area Percentage of Bainite, Martensite, and Retained Austenite: 15% or less When bainite and/or martensite, which is hard, is present during close-contact bending, the difference in hardness between ferrite and bainite and/or martensite is increased. Thus, the interface between ferrite and bainite and/or martensite serves as a starting point of void formation, deteriorating the close-contact bendability. Retained austenite is transformed into martensite during close-contact bending. Thus, the reduction of the total area percentage of bainite, martensite, and retained austenite is needed in order to obtain good close-contact bendability. When the total area percentage of bainite, martensite, and retained austenite is more than 15%, the above-described problem is significantly manifested. Thus, the total area percentage of bainite, martensite, and retained austenite is 15% or less. The total area percentage of bainite, martensite, and retained austenite is preferably 10% or less, more preferably 5% or less. The lower limit is not particularly limited and may be 1% or more or 2% or more. However, the total area percentage thereof is preferably as small as possible. Thus, the lower limit may be 0%.

Area Percentage of Ferrite Grains Each Containing Three or more Cementite Grains Having Aspect Ratio of 1.5 or less: 30% or less When three or more cementite grains having an aspect ratio of 1.5 or less are present in one ferrite grain, the void formation is promoted in the boundary between the ferrite and cementite grains. When the area percentage of the ferrite grains each containing three or more cementite grains is more than 30%, voids are connected during close-contact bending, thereby deteriorating the close-contact bendability. The cementite grains having an aspect ratio of more than 1.5 are cementite grains precipitated during pearlite transformation and thus are counted in the area percentage of the pearlite phase. Accordingly, the area percentage of ferrite grains each containing three or more cementite grains having an aspect ratio of 1.5 or less is 30% or less. The area percentage of ferrite grains each containing three or more cementite grains having an aspect ratio of 1.5 or less is preferably 25% or less, more preferably 20% or less. The lower limit is not particularly limited and may be 0%. The aspect ratio used here is determined by approximating each cementite grain as an ellipse and dividing the length of the major axis of the cementite grain by the length of the minor axis.

Inclusions Having Particle Size of 10 μm or more Present in Portion Extending from Surface to ¼ Thickness Position: 2.0 particles/mm$^2$ or less Inclusions having a particle size of 10 μm or more act as starting points of voids. When the number of the coarse inclusions is more than 2.0 particles/mm$^2$, voids are connected during close-contact bending to deteriorate the close-contact bendability. In particular, when the coarse inclusions are present in a portion extending from a surface to a ¼ thickness position, high stress is applied during close-contact bending to form voids, thereby deteriorating the close-contact bendability. When coarse inclusions are present in a portion extending from the ¼ thickness position to the center of the steel sheet in the thickness direction, stress applied during the close-contact bending is not high. Thus, voids are less likely to be formed, and the close-contact bendability is not deteriorated. Accordingly, the number of inclusions having a particle size of 10 μm or more present in the portion extending from the surface to the ¼ thickness position needs to be controlled to 2.0 particles/mm$^2$ or less. The number of inclusions having a particle size of 10 μm or more present in the portion extending from the surface to the ¼ thickness position is preferably 1.5 particles/mm$^2$ or less, more preferably 1 piece/mm$^2$ or less. The lower limit is not particularly limited and may be 0 particles/mm$^2$. The term "surface" refers to a surface of the base steel sheet excluding a coated layer when the steel sheet includes the coated layer.

A steel microstructure was observed as follows: A ¼ thickness position in the thickness direction on a section of a steel sheet, the section being perpendicular to the rolling direction of the steel sheet, was polished, etched with 3% by mass nital, and observed in three fields of view with a scanning electron microscope (SEM) at a magnification of ×1,000. The area percentage of each phase was determined by a point counting method in which a 16×15 grid of points at 4.8 μm intervals was placed on a region, measuring 82 μm×57 μm in terms of actual length, of a SEM image with a magnification of ×1,000 and the number of points over a phase was counted. The area percentage of each phase was defined as the average of the measurements (three fields of view). The number of inclusions having a particle size of 10 μm or more present in a portion extending from a surface to a ¼ thickness position was determined by polishing a section of a steel sheet in the thickness direction perpendicular to the rolling direction of the steel sheet, etching the section with 3% by mass nital, observing the portion extending from the surface to the ¼ thickness position with the SEM at a magnification of ×1,000, and counting the inclusions. The particle size was defined as the average of the major axis and the minor axis.

The steel sheet of the disclosed embodiments may include a coated layer on a surface thereof. As the coated layer, a hot-dip galvanized layer (also referred to as "GI"), a hot-dip galvannealed layer (also referred to as "GA"), or an electrogalvanized layer is preferred. In the case of the hot-dip galvannealed layer, the Fe content is preferably in the range of 7% to 15% by mass. An Fe content of less than 7% by mass results in the occurrence of uneven alloying or the deterioration of flaking properties. An Fe content of more than 15% by mass results in the deterioration of coating peel resistance. A coating metal other than zinc may be used. For example, Al coating or the like may be used.

The properties of the steel sheet of the disclosed embodiments will be described below. Since the steel sheet of the disclosed embodiments has the component composition and the steel structure described above and thus has the following characteristics.

The steel sheet of the disclosed embodiments has a high strength. Specifically, the tensile strength (TS) measured by a method described in the examples is 370 MPa or more. The steel sheet preferably has a tensile strength of 400 MPa or more, more preferably 420 MPa or more. The upper limit of the tensile strength is not particularly limited. In light of an easy balance with other properties, the tensile strength is preferably 700 MPa or less, more preferably 650 MPa or less, even more preferably 600 MPa or less, particularly preferably less than 590 MPa.

The steel sheet of the disclosed embodiments has a high ductility. Specifically, the elongation at break (El) measured by a method described in the examples is 35.0% or more, preferably 37.0% or more, more preferably 39.0% or more. The upper limit of the elongation at break is not particularly limited. In light of an easy balance with other properties, the elongation at break is preferably 60.0% or less, more preferably 55.0% or less, even more preferably 50.0% or less.

The steel sheet of the disclosed embodiments is excellent in close-contact bendability. Specifically, the expression "excellent in close-contact bendability" indicates that when evaluation is performed by a method described in the examples, a crack of 0.2 mm or more is not formed in a bending ridge line portion.

A method for producing a steel sheet of the disclosed embodiments will be described below. The production method of the disclosed embodiments includes a hot-rolling step, a pickling step, a cold-rolling step that is performed as needed, and an annealing step.

Hot-Rolling Step

The hot-rolling step is a step of hot-rolling a steel having a component composition on the conditions: an average cooling rate after continuous casting of 0.5° C./s or more and a residence time of 2,000 to 3,000 seconds in a temperature range of 1,150° C. or higher, and performing coiling at a coiling temperature of 600° C. or lower.

Average cooling rate after continuous casting: 0.5° C./s or more

An average cooling rate after continuous casting of less than 0.5° C./s results in the coarsening of carbonitride-based inclusions. The average cooling rate is 0.5° C./s or more, preferably 0.7° C./s or more. The average cooling rate used here refers to an average cooling rate measured on the basis of the surface temperature of the steel to be hot-rolled. When the average cooling rate at the surface is within this range, carbonitride-based inclusions in the middle are less likely to coarsen. Even if the carbonitride-based inclusions are coarsened, the close-contact bendability is not affected because stress applied to and near the middle portion during close-contact bending is smaller than that at the surface. The upper limit need not be particularly limited. An excessively high average cooling rate may cause a crack on the surface of a cast slab. Thus, the average cooling rate after continuous casting is preferably 1,000° C./s or less.

Residence time in temperature range of 1,150° C. or higher: 2,000 to 3,000 seconds In the time from the start of slab heating to the end of the hot rolling, the residence time at a temperature of 1,150° C. or higher is 2,000 seconds or more and 3,000 seconds or less. When the residence time is less than 2,000 seconds, sulfide formed during casting does not dissolve but coarsens to deteriorate the close-contact bendability. Accordingly, the residence time in the temperature range of 1,150° C. or higher is 2,000 seconds or more. The residence time in the temperature range of 1,150° C. or higher is preferably 2,300 seconds or more. An excessively long residence time in the temperature range of 1,150° C. or higher results in the formation and coarsening of inclusions, thereby deteriorating the close-contact bendability. Accordingly, the residence time in the temperature range of 1,150° C. or higher is 3,000 seconds or less. The residence time in the temperature range of 1,150° C. or higher is preferably 2,800 seconds or less, more preferably 2,600 seconds or less.

Finishing Temperature of Finish Rolling: Ar3 Point or Higher (Preferable Condition)

When the finishing temperature of the finish rolling is lower than Ar3 point, a strained ferrite phase or hard bainite is formed. This can cause an unrecrystallized ferrite phase or bainite to remain in an annealed microstructure to decrease the ductility. Accordingly, the finishing temperature of the finish rolling is preferably the Ar3 point or higher. The Ar3 point can be calculated from formula (1):

$$Ar3=910-310\times[C]-80\times[Mn]+0.35\times(t-0.8), \quad (1)$$

where [M] represents the element M content (% by mass), and t represents the thickness of the sheet (mm). Correction terms are introduced in accordance with elements contained. When Cu, Cr, Ni, and Mo are contained, correction terms, such as −20×[Cu], −15×[Cr], −55×[Ni], and −80×[Mo], are added to the right-hand side of formula (1).

Coiling Temperature: 600° C. or lower

A coiling temperature of higher than 600° C. results in an increase in the area percentage of a pearlite phase. The annealed steel sheet has a steel microstructure in which the area percentage of the pearlite phase is higher than 30%, which causing a decrease in ductility. Accordingly, the coiling temperature is 600° C. or lower. The coiling temperature is preferably 200° C. or higher, because otherwise the shape of the hot-rolled steel sheet is deteriorated.

Pickling Step

The pickling step is a step of pickling the steel sheet that has been subjected to the hot rolling step. In the pickling step, mill scale formed on surfaces is removed. The pickling conditions are not particularly limited.

Cold-Rolling Step

The cold-rolling step is a step performed as needed and a step of cold-rolling the steel sheet that has been subjected to the pickling step. A rolling reduction ratio in the cold rolling is preferably 40% or more. When the rolling reduction ratio in the cold rolling is less than 40%, the recrystallization of the ferrite phase does not easily proceed. This can cause an unrecrystallized ferrite phase to remain in an annealed microstructure to decrease the ductility. Accordingly, the rolling reduction ratio in the cold rolling is preferably 40% or more.

Annealing Step

The annealing step includes heating the steel sheet that has been subjected to the hot-rolling step or the cold-rolling step to (Ac1+20°) C. or higher at an average heating rate of 2.0° C./s or more until 400° C., holding the steel sheet in a temperature range of (Ac1+20°) C. or higher for 10 seconds or more and 300 seconds or less, after the holding, cooling the steel sheet to 550° C. or lower at an average cooling rate of 10 to 200° C./s until 550° C., holding the steel sheet in a temperature range of 350° C. or higher and 550° C. or lower for 30 to 800 seconds, and after the holding, cooling the steel sheet at an average cooling rate of 2.0° C./s or more and 5.0° C./s or less until 200° C.

Heating at Average Heating Rate of 2.0° C./s or more Until 400° C.

This condition is one of the important conditions in the disclosed embodiments. The temperature range of 400° C. or lower is a temperature range in which cementite is formed. Heating this temperature range at less than 2.0° C./s coarsens cementite which has been remained or forms new cementite and the cementite remains after the annealing, thereby deteriorating the close-contact bendability. Accordingly, heating is performed at an average heating rate of 2.0° C./s or more until 400° C. The average heating rate until 400° C. is preferably 2.5° C./s or more, more preferably 3.0° C./s or more. The upper limit of the average heating rate is not particularly limited but is usually 15.0° C./s or less. This heating is performed until (Ac1+20°) C. or higher, which is the following annealing temperature. The average heating rate until 400° C. is 2.0° C./s or more, and in a temperature range of higher than 400° C., usual heating conditions may be appropriately used as the average heating rate.

Holding at (Ac1+20°) C. or Higher for 10 Seconds or more and 300 Seconds or less When the annealing temperature is lower than (Ac1+20°) C. or when the annealing time for which the annealing temperature is held is less than 10 seconds, cementite is not sufficiently dissolved during the annealing. The presence of the cementite phase deteriorates the close-contact bendability. When the cementite phase is present, carbon (C) is used for cementite. Thus, the amount of C that contributes to (solid-solution) hardening is decreased to decrease the strength, in some cases. Accordingly, the annealing temperature is (Ac1+20°) C. or higher. The annealing temperature is preferably (Ac1+30°) C. or higher, more preferably (Ac1+40°) C. or higher. The annealing time is 10 seconds or more. The annealing time is preferably 20 seconds or more, more preferably 30 seconds or more. An annealing time of more than 300 seconds results in the coarsening of inclusions to deteriorate the close-contact bendability. Accordingly, the annealing time is 300 seconds or less. The annealing time is preferably 270 seconds or less, more preferably 240 seconds or less. The upper limit of the annealing temperature is not particularly specified. The effect is saturated at a temperature of higher than 900° C. Thus, the annealing temperature is preferably 900° C. or lower. The Ac1 point can be calculated from formula (2):

$$Ac1=723+22\times[Si]-18\times[Mn]+17\times[Cr]+4.5\times[Mo]+16\times[V] \quad (2)$$

where [M] represents the element M content (% by mass).

Cooling to 550° C. or Lower at Average Cooling Rate of 10 to 200° C./s Until 550° C.

This condition is one of the important conditions in the disclosed embodiments. After the holding at the annealing temperature described above, the area percentage of a pearlite phase to be formed can be controlled by rapid cooling at a higher average cooling rate until 550° C. The cooling is preferably performed at an average cooling rate of 10 to 200° C./s until 520° C. or lower, more preferably at an average cooling rate of 10 to 200° C./s until 500° C. or lower. When the average cooling rate until 550° C. is less than 10° C./s, pearlite is not formed, and cementite precipitation in ferrite is promoted. Thereby, the area percentage of ferrite grains each containing three or more cementite grains is more than 30%, thus deteriorating the close-contact bendability. Accordingly, the average cooling rate until 550° C. is 10° C./s or more. The average cooling rate until 550° C. is preferably 12° C./s or more, more preferably 15° C./s or more. When the average cooling rate until 550° C. is more than 200° C./s, the pearlite phase is excessively precipitated, increasing the strength, decreasing the ductility, and deteriorating the close-contact bendability. Accordingly, the average cooling rate until 550° C. is 200° C./s or less. The cooling stop temperature is preferably 350° C. or higher because the holding is performed at 350° C. or higher and 550° C. or lower as described below. When the cooling stop temperature is lower than 350° C., heating is performed in order to perform the holding at 350° C. or higher and 550° C. or lower.

Holding in Temperature Range of 350° C. or Higher and 550° C. or Lower for 30 to 800 Seconds When the holding time in the temperature range of 350° C. or higher and 550° C. or lower is less than 30 seconds, pearlite transformation does not proceed sufficiently, and retained austenite is transformed into martensite after the cooling; thus, the ductility is easily decreased, and the close-contact bendability is deteriorated. Accordingly, the holding time in the temperature range of 350° C. or higher and 550° C. or lower needs to be 30 seconds or more. The holding time in the temperature range of 350° C. or higher and 550° C. or lower is preferably 40 seconds or more, more preferably 50 seconds or more. When the holding time in the temperature range of 350° C. or higher and 550° C. or lower is more than 800 seconds, the area percentage of pearlite is more than 30%, thereby decreasing the ductility and the close-contact bendability. Accordingly, the holding time in the temperature range of 350° C. or higher and 550° C. or lower is 800 seconds or less. The holding time in the temperature range of 350° C. or higher and 550° C. or lower is preferably 750 seconds or less, more preferably 700 seconds or less. When the holding temperature is higher than 550° C., the area percentage of pearlite is 30% or more, thereby decreasing the ductility and the close-contact bendability. Accordingly, the holding temperature is 550° C. or lower. The holding temperature is preferably 520° C. or lower, more preferably 500° C. or lower. A holding temperature of lower than 350° C. results in the formation of bainite to deteriorate the close-contact bendability. Accordingly, the holding temperature is 350° C. or higher. The holding temperature is preferably 365° C. or higher, more preferably 380° C. or higher.

Cooling at Average Cooling Rate of 2.0° C./s or more and 5.0° C./s or less Until 200° C.

After the holding in the temperature range of 350° C. or higher and 550° C. or lower for 30 to 800 seconds, cooling is performed under this condition. This condition is one of the important conditions in the disclosed embodiments. This temperature range is a temperature range in which cementite is formed. For the same reason as in the case of the average heating rate at the time of heating until 400° C., the average cooling rate until 200° C. is 2.0° C./s or more. The average cooling rate until 200° C. is preferably 2.3° C./s or more, more preferably 2.6° C./s or more. In this temperature range, austenite that has not been transformed during the holding needs to be sufficiently transformed into pearlite. When the average cooling rate until 200° C. is more than 5.0° C./s, cementite is less likely to be formed. Retained austenite is transformed into martensite to increase the difference in hardness between martensite and ferrite, thereby decreasing the close-contact bendability and the ductility. Accordingly, the average cooling rate until 200° C. is 5.0° C./s or less. The average cooling rate until 200° C. is preferably 4.7° C./s or less, more preferably 4.3° C./s or less. The cooling stop temperature in this cooling is preferably 10° C. to 200° C.

In the case where a steel sheet including a coated layer is produced, after holding is performed in the temperature range of 350° C. or higher and 550° C. or lower for 30 to 800 seconds, coating treatment may be performed before cooling. Furthermore, after the coating treatment, alloying treatment may be performed. When the alloying treatment is performed, for example, a steel sheet is heated to 450° C. or higher and 600° C. or lower to perform the alloying treatment. Otherwise, after cooling, electrogalvanizing treatment may be performed.

In the heat treatment in the production method of the disclosed embodiments, the holding temperature is not necessarily constant as long as it is within the temperature range described above. Even if the cooling rate varies during cooling, there is no problem as long as the cooling rate is within the specified cooling rate range. In the heat treatment, as long as a desired heat history is satisfied, the gist of the disclosed embodiments is not impaired even if the heat treatment is performed using any equipment. Additionally, temper rolling for shape correction is also included in the scope of the disclosed embodiments. Furthermore, in the disclosed embodiments, even if various surface treatments, such as chemical conversion treatment, are performed on the resulting coated steel sheet, the advantageous effects of the disclosed embodiments are not impaired.

Examples

The disclosed embodiments will be specifically described below on the basis of examples.

Steels (slabs) having component compositions presented in Table 1 were used as starting materials. These steels were subjected to hot rolling, pickling, cold rolling, and annealing under conditions presented in Table 2. Some steel sheets (steel sheet Nos. 1 and 5) were not subjected to cold rolling. Then some steel sheets (steel sheet Nos. 34 to 42) were subjected to galvanizing treatment.

The steel sheets obtained as described above were evaluated in terms of microstructure observation, tensile properties, and close-contact bendability. Measurement methods were described below. Table 3 presents the results.

(1) Observation of Steel Microstructure

A ¼ thickness position on a section of a steel sheet in the thickness direction perpendicular to the rolling direction of the steel sheet was polished, etched with 3% by mass nital, and observed in three fields of view with a scanning electron microscope (SEM) at a magnification of ×1,000. The area percentage of each phase was determined by a point counting method in which a 16×15 grid of points at 4.8 μm intervals was placed on a region, measuring 82 μm×57 μm in terms of actual length, of a SEM image with a magnification of ×1,000 and total number of points over each phase was counted. The area percentage of each phase was defined as the average of the measurements (three fields of view).

The aspect ratio of cementite was determined as follows: The length of the major axis and the length of the minor axis of each cementite grain present in ferrite observed by the above method were measured by using a SEM image enlarged to a magnification of ×5,000, and then the length of the major axis was divided by the length of the minor axis for each cementite.

Figure 2:
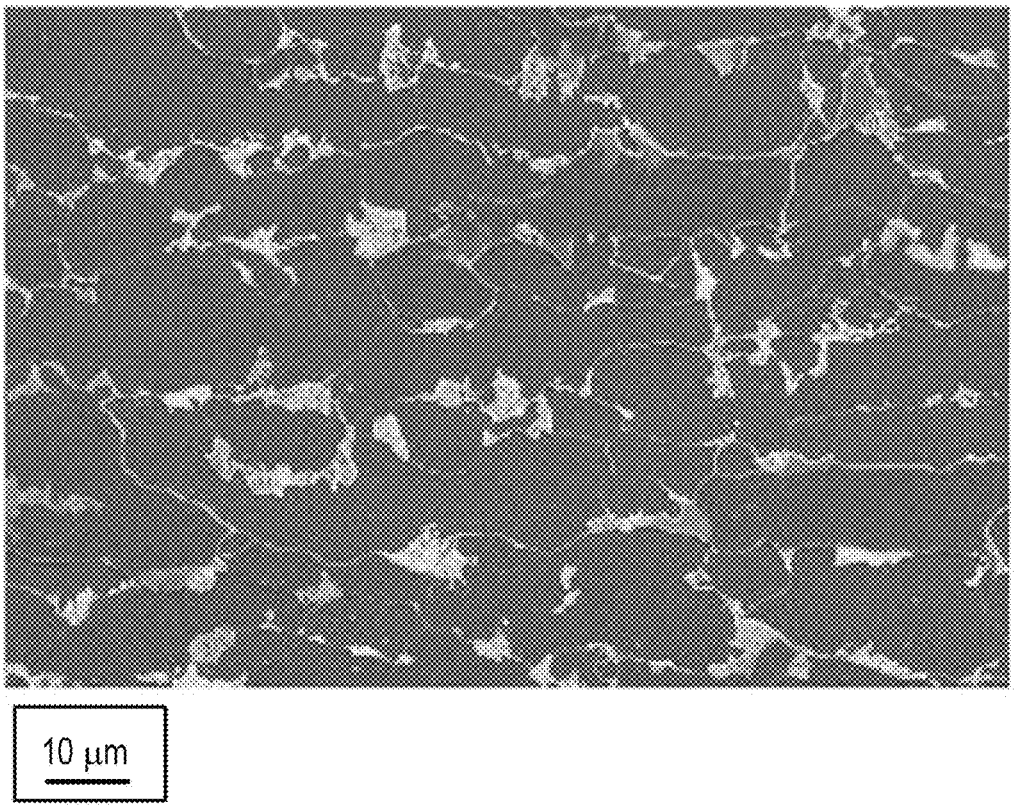
FIG. 2 illustrates an example of a SEM image of an example.

The number of inclusions having a particle size of 10 μm or more present in a portion extending from a surface to a ¼ thickness position was determined by polishing a section of a steel sheet in the thickness direction perpendicular to the rolling direction of the steel sheet, etching the section with 3% by mass nital, observing randomly-selected fields of view in the portion extending from the surface to the ¼ thickness position with the SEM at a magnification of ×1,000, and counting the inclusions. The particle size was defined as the average of the major axis and the minor axis. As examples of the SEM image, a SEM image of No. 22 of a comparative example is illustrated in FIG. 1, and a SEM image of No. 23 of an example is illustrated in FIG. 2.

(2) Tensile Properties

A JIS No. 5 tensile test piece was taken from each of the resulting steel sheets along a rolling direction, and a tensile test (JIS Z 2241 (2011)) was performed. The tensile test was performed until the test piece was broken, and the tensile strength and the elongation at break (ductility) were determined. A tensile strength of 370 MPa or more was evaluated as good. Regarding the evaluation criterion for the ductility, the ductility was determined to be good when the elongation at break was 35.0% or more.

(3) Close-Contact Bendability

A bending test piece having a width of 30 mm in the rolling direction and a length of 100 mm in the perpendicular direction was cut out from each of the resulting steel sheets. The bending test piece was U-bent at a radius of 0.5 mm and then the test piece was pressed at 10 tons in such a manner that the gap between steel sheet portions of the test piece was eliminated and that the steel sheet portions were brought into close contact with each other. Then the bending ridge line portion of the resultant test piece was observed with a stereoscopic microscope at a magnification of ×20 and examined for cracks. The close-contact bendability was evaluated as described below.

When a crack of 0.2 mm or more had been formed on the bending ridge line portion, the steel sheet was evaluated as "fail". When no crack was formed, the steel sheet was evaluated as "pass".

Table 3 indicates that high-strength steel sheets having high ductility and good close-contact bendability were obtained in the examples, each of the steel sheets having 50% or more by area of a ferrite phase, 5% to 30% by area of a pearlite phase, and 15% by area or less in total of bainite, martensite, and retained austenite, in which the area percentage of ferrite grains each containing three or more cementite grains having an aspect ratio of 1.5 or less was 30% or less, and the number of inclusions having a particle size of 10 μm or more present in a portion extending from a surface to a ¼ thickness position was 2.0 particles/mm$^2$ or less. In contrast, in the comparative examples, any one or more of the strength, the ductility, and the close-contact bendability were poor. The observed inclusions having a particle size of 10 μm or more had a particle size of less than 20 Thus, an improvement in close-contact bendability was seemingly affected by inclusions having a particle size of 10 μm or more and less than 20 μm. In steels each having a composition different from the disclosed embodiments, even when the production conditions were adjusted, any one or more of the strength, the ductility, and the close-contact bendability were poor.

TABLE 1

| Type of steel | Component composition (% by mass) C | Si | Mn | P | S | Al | N | Cr | V | Mo | Cu | Ni | B | Ca | REM | Ar3 point | Ac1 point | Remarks |
|---|---|---|---|---|---|---|---|---|---|---|---|---|---|---|---|---|---|---|
| A | 0.11 | 0.10 | 0.67 | 0.010 | 0.002 | 0.045 | 0.004 | | | | | | | | | 823 | 713 | Example |
| B | 0.16 | 0.02 | 0.55 | 0.005 | 0.006 | 0.026 | 0.003 | | | | | | | | | 817 | 714 | Example |
| C | 0.23 | 0.15 | 0.60 | 0.018 | 0.003 | 0.038 | 0.004 | | | | | | | | | 791 | 716 | Example |
| D | 0.16 | 0.30 | 0.73 | 0.008 | 0.003 | 0.035 | 0.005 | | | | | | | | | 802 | 716 | Example |
| E | 0.14 | 0.01 | 0.52 | 0.024 | 0.002 | 0.043 | 0.004 | 0.02 | | | | | | | | 825 | 714 | Example |
| F | 0.17 | 0.07 | 0.43 | 0.019 | 0.007 | 0.036 | 0.003 | | 0.01 | | | | | | | 823 | 717 | Example |
| G | 0.16 | 0.12 | 0.35 | 0.023 | 0.008 | 0.034 | 0.002 | | | 0.02 | | | | | | 833 | 719 | Example |
| H | 0.18 | 0.30 | 0.57 | 0.020 | 0.013 | 0.034 | 0.003 | | | | 0.05 | | | | | 808 | 719 | Example |
| I | 0.17 | 0.09 | 0.56 | 0.018 | 0.008 | 0.048 | 0.004 | | | | | 0.05 | | | | 813 | 715 | Example |
| J | 0.14 | 0.03 | 0.70 | 0.016 | 0.002 | 0.035 | 0.003 | | | | | | 0.002 | | | 811 | 711 | Example |
| K | 0.20 | 0.11 | 0.45 | 0.018 | 0.003 | 0.038 | 0.003 | | | | | | | 0.003 | | 812 | 717 | Example |
| L | 0.15 | 0.23 | 0.28 | 0.014 | 0.004 | 0.041 | 0.010 | | | | | | | | 0.003 | 841 | 723 | Example |
| M | 0.07 | 0.12 | 0.68 | 0.014 | 0.004 | 0.033 | 0.003 | | | | | | | | | 834 | 713 | Comparative example |
| N | 0.28 | 0.17 | 0.41 | 0.008 | 0.003 | 0.038 | 0.004 | | | | | | | | | 791 | 719 | Comparative example |
| O | 0.14 | 1.15 | 0.60 | 0.012 | 0.004 | 0.031 | 0.003 | | | | | | | | | 819 | 738 | Comparative example |
| P | 0.16 | 0.09 | 0.81 | 0.007 | 0.004 | 0.027 | 0.003 | | | | | | | | | 796 | 710 | Comparative example |
| Q | 0.17 | 0.11 | 0.71 | 0.014 | 0.003 | 0.220 | 0.004 | | | | | | | | | 801 | 713 | Comparative example |

TABLE 2

| No | Type of steel | Casting Cooling rate ° C./s | Hot rolling: Heating temperature ° C. | Residence time at 1,150° C. or higher s | Finishing temperature ° C. | Coiling temperature ° C. | Cold rolling Rolling reduction ratio % | Production condition: Average heating rate to 400° C. ° C./s |
|---|---|---|---|---|---|---|---|---|
| 1 | A | 1.5 | 1250 | 2500 | 880 | 550 | — | 2.9 |
| 2 | | 1.4 | 1250 | 2200 | 880 | 550 | 56 | 2.9 |
| 3 | | 0.5 | 1250 | 2000 | 880 | 550 | 56 | 3.1 |
| 4 | | 0.3 | 1250 | 2000 | 880 | 550 | 56 | 3.0 |
| 5 | B | 1.2 | 1250 | 2600 | 880 | 550 | — | 2.9 |
| 6 | | 1.4 | 1250 | 2200 | 880 | 550 | 56 | 3.1 |
| 7 | | 1.3 | 1250 | 2300 | 880 | 550 | 56 | 3.1 |
| 8 | | 0.9 | 1250 | 2000 | 880 | 550 | 56 | 3.1 |
| 9 | C | 0.6 | 1250 | 2700 | 780 | 550 | 56 | 3.1 |
| 10 | | 1.3 | 1250 | 2600 | 880 | 550 | 56 | 3.1 |
| 11 | | 0.7 | 1250 | 2500 | 880 | 650 | 56 | 3.1 |
| 12 | D | 1.4 | 1250 | 2400 | 880 | 550 | 56 | 1.8 |
| 13 | | 1.5 | 1250 | 2400 | 880 | 550 | 56 | 2.2 |
| 14 | | 0.8 | 1250 | 2100 | 880 | 550 | 56 | 2.8 |
| 15 | | 0.7 | 1250 | 2100 | 880 | 550 | 56 | 3.2 |
| 16 | E | 1.0 | 1250 | 2100 | 880 | 550 | 56 | 3.2 |
| 17 | | 1.4 | 1250 | 2600 | 880 | 550 | 56 | 3.2 |
| 18 | | 0.8 | 1250 | 1800 | 880 | 550 | 56 | 3.2 |
| 19 | | 0.6 | 1250 | 2700 | 880 | 550 | 56 | 3.2 |
| 20 | | 0.7 | 1250 | 2400 | 880 | 550 | 56 | 3.2 |
| 21 | | 0.9 | 1250 | 2000 | 880 | 550 | 56 | 3.2 |
| 22 | F | 0.8 | 1250 | 2700 | 880 | 550 | 56 | 3.2 |
| 23 | | 1.1 | 1250 | 2200 | 880 | 550 | 56 | 3.2 |
| 24 | | 0.8 | 1250 | 3000 | 880 | 550 | 56 | 3.2 |
| 25 | G | 1.5 | 1250 | 2100 | 880 | 550 | 56 | 3.2 |
| 26 | | 1.0 | 1250 | 3500 | 880 | 550 | 56 | 3.2 |
| 27 | | 0.9 | 1250 | 2400 | 880 | 550 | 56 | 3.2 |
| 28 | H | 0.7 | 1250 | 2600 | 880 | 550 | 56 | 3.2 |
| 29 | | 0.7 | 1250 | 2700 | 880 | 550 | 56 | 3.2 |
| 30 | | 0.8 | 1250 | 2600 | 880 | 550 | 56 | 3.2 |
| 31 | I | 0.5 | 1250 | 2400 | 880 | 550 | 56 | 3.0 |
| 32 | | 1.4 | 1250 | 2300 | 880 | 550 | 56 | 3.0 |
| 33 | | 0.8 | 1250 | 2000 | 880 | 550 | 56 | 3.0 |
| 34 | J | 0.6 | 1250 | 2100 | 880 | 550 | 56 | 3.0 |
| 35 | | 0.6 | 1250 | 2200 | 880 | 550 | 56 | 3.0 |
| 36 | | 0.7 | 1250 | 2000 | 880 | 550 | 56 | 3.0 |
| 37 | K | 0.9 | 1250 | 2800 | 880 | 550 | 56 | 3.0 |
| 38 | | 0.8 | 1250 | 2500 | 880 | 550 | 56 | 3.0 |
| 39 | | 1.5 | 1250 | 2600 | 880 | 550 | 56 | 3.0 |
| 40 | L | 1.2 | 1250 | 2100 | 880 | 550 | 56 | 3.0 |

TABLE 2-continued

| | | | | | | | |
|---|---|---|---|---|---|---|---|
| 41 | 1.4 | 1250 | 2200 | 880 | 550 | 56 | 3.0 |
| 42 | 1.3 | 1250 | 2800 | 880 | 550 | 56 | 3.0 |
| 43 M | 1.4 | 1250 | 2400 | 880 | 550 | 56 | 2.9 |
| 44 N | 1.2 | 1250 | 2200 | 880 | 550 | 56 | 2.9 |
| 45 O | 0.7 | 1250 | 2700 | 880 | 550 | 56 | 2.9 |
| 46 P | 1.3 | 1250 | 2900 | 880 | 550 | 56 | 2.9 |
| 47 Q | 1.5 | 1250 | 2900 | 880 | 550 | 56 | 2.9 |

| | Production condition | | | | | | |
|---|---|---|---|---|---|---|---|
| No | Annealing temperature ° C. | Annealing time s | Average cooling rate to 550° C. ° C./s | Holding temperature ° C. | Holding time s | Average cooling rate to 200° C. ° C./s | Coating treatment |
| 1 | 840 | 150 | 20 | 500 | 600 | 2.7 | — |
| 2 | 740 | 150 | 18 | 500 | 600 | 2.7 | — |
| 3 | 740 | 150 | 23 | 400 | 600 | 3.1 | — |
| 4 | 840 | 150 | 23 | 400 | 600 | 3.5 | — |
| 5 | 800 | 8 | 23 | 470 | 600 | 2.8 | — |
| 6 | 800 | 40 | 23 | 470 | 600 | 2.6 | — |
| 7 | 800 | 200 | 23 | 470 | 600 | 2.8 | — |
| 8 | 800 | 350 | 23 | 470 | 600 | 3.4 | — |
| 9 | 840 | 150 | 18 | 470 | 600 | 3.3 | — |
| 10 | 840 | 150 | 18 | 470 | 600 | 3.3 | — |
| 11 | 840 | 150 | 18 | 470 | 600 | 3.3 | — |
| 12 | 840 | 150 | 18 | 470 | 600 | 3.5 | — |
| 13 | 840 | 150 | 18 | 470 | 600 | 2.8 | — |
| 14 | 840 | 150 | 18 | 470 | 600 | 2.7 | — |
| 15 | 840 | 150 | 18 | 470 | 600 | 2.8 | — |
| 16 | 840 | 150 | 20 | 470 | 600 | 1.8 | — |
| 17 | 840 | 150 | 20 | 470 | 600 | 2.2 | — |
| 18 | 840 | 150 | 20 | 470 | 600 | 2.7 | — |
| 19 | 840 | 150 | 20 | 470 | 600 | 4.5 | — |
| 20 | 840 | 150 | 20 | 470 | 600 | 4.8 | — |
| 21 | 840 | 150 | 20 | 470 | 600 | 5.5 | — |
| 22 | 720 | 150 | 18 | 470 | 600 | 3.5 | — |
| 23 | 780 | 150 | 20 | 470 | 600 | 3.8 | — |
| 24 | 840 | 150 | 23 | 470 | 600 | 4.1 | — |
| 25 | 800 | 150 | 8 | 470 | 600 | 3.8 | — |
| 26 | 800 | 150 | 14 | 470 | 600 | 3.7 | — |
| 27 | 800 | 150 | 30 | 470 | 600 | 3.5 | — |
| 28 | 800 | 150 | 80 | 470 | 600 | 3.5 | — |
| 29 | 800 | 150 | 150 | 470 | 600 | 3.6 | — |
| 30 | 800 | 150 | 220 | 470 | 600 | 3.7 | — |
| 31 | 800 | 150 | 18 | 330 | 600 | 2.8 | — |
| 32 | 800 | 150 | 18 | 355 | 600 | 2.8 | — |
| 33 | 800 | 150 | 18 | 400 | 600 | 2.7 | — |
| 34 | 800 | 150 | 18 | 470 | 600 | 2.8 | electroplating |
| 35 | 800 | 150 | 18 | 540 | 600 | 2.7 | electroplating |
| 36 | 800 | 150 | 18 | 570 | 600 | 2.6 | electroplating |
| 37 | 800 | 150 | 18 | 470 | 20 | 2.9 | GA |
| 38 | 800 | 150 | 18 | 470 | 35 | 2.9 | GA |
| 39 | 800 | 150 | 18 | 470 | 120 | 2.9 | GA |
| 40 | 800 | 150 | 18 | 470 | 400 | 3.0 | GI |
| 41 | 800 | 150 | 20 | 470 | 780 | 3.0 | GI |
| 42 | 800 | 150 | 23 | 470 | 850 | 2.8 | GI |
| 43 | 800 | 150 | 23 | 470 | 600 | 3.0 | — |
| 44 | 800 | 150 | 23 | 470 | 600 | 2.9 | — |
| 45 | 800 | 150 | 23 | 470 | 600 | 2.7 | — |
| 46 | 800 | 150 | 18 | 470 | 600 | 2.8 | — |
| 47 | 800 | 150 | 18 | 470 | 600 | 2.8 | — |

TABLE 3

| | | Microstructure | | | | | Property | | | |
|---|---|---|---|---|---|---|---|---|---|---|
| No | Type of steel | Area percentage of ferrite % | Area percentage of pearlite % | Total area percentage of bainite, martensite, and retained austenite % | Area percentage of ferrite grains each containing three or more cementite grains with aspect ratio of 1.5 or less % | Inclusions with particle size of 10 μm or more present in portion extending from surface to ¼ thickness position particles/mm$^2$ | TS MPa | EI % | Close-contact bendability | |
| 1 | A | 77 | 23 | 3 | 5 | 0 | 438 | 43.1 | pass | Example |
| 2 | | 80 | 20 | 2 | 5 | 0.4 | 425 | 43.8 | pass | Example |
| 3 | | 79 | 19 | 3 | 6 | 1.8 | 421 | 44.1 | pass | Example |
| 4 | | 76 | 22 | 4 | 3 | 2.3 | 434 | 43.0 | fail | Comparative example |
| 5 | B | 91 | 4 | 3 | 44 | 1.1 | 364 | 48.3 | fail | Comparative example |
| 6 | | 90 | 9 | 3 | 18 | 0.6 | 407 | 44.6 | pass | Example |
| 7 | | 81 | 19 | 3 | 0 | 0.9 | 452 | 42.9 | pass | Example |
| 8 | | 80 | 20 | 1 | 10 | 2.4 | 437 | 44.8 | fail | Comparative example |
| 9 | C | 88 | 11 | 2 | 10 | 1.7 | 446 | 41.9 | pass | Example |
| 10 | | 79 | 21 | 1 | 11 | 0.9 | 540 | 36.5 | pass | Example |
| 11 | | 68 | 32 | 0 | 7 | 1.6 | 599 | 26.8 | fail | Comparative example |
| 12 | D | 72 | 21 | 4 | 33 | 0.8 | 489 | 37.8 | fail | Comparative example |
| 13 | | 74 | 22 | 1 | 24 | 0.3 | 494 | 38.4 | pass | Example |
| 14 | | 79 | 21 | 1 | 9 | 1.5 | 489 | 38.5 | pass | Example |
| 15 | | 81 | 19 | 5 | 6 | 1.6 | 479 | 40.1 | pass | Example |
| 16 | E | 77 | 17 | 4 | 32 | 1.1 | 420 | 45.5 | fail | Comparative example |
| 17 | | 78 | 19 | 1 | 16 | 0.5 | 428 | 45.3 | pass | Example |
| 18 | | 77 | 23 | 1 | 2 | 2.9 | 445 | 43.9 | fail | Comparative example |
| 19 | | 78 | 18 | 7 | 1 | 1.9 | 424 | 42.7 | pass | Example |
| 20 | | 74 | 19 | 11 | 1 | 1.7 | 428 | 34.5 | pass | Example |
| 21 | | 67 | 20 | 16 | 0 | 1.5 | 433 | 28.5 | fail | Comparative example |
| 22 | F | 89 | 8 | 2 | 72 | 1.5 | 358 | 49.6 | fail | Comparative example |
| 23 | | 86 | 12 | 0 | 13 | 1.0 | 413 | 43.3 | pass | Example |
| 24 | | 82 | 16 | 2 | 2 | 1.7 | 431 | 42.9 | pass | Example |
| 25 | G | 90 | 6 | 4 | 35 | 0.2 | 436 | 39.5 | fail | Comparative example |
| 26 | | 89 | 11 | 2 | 21 | 2.3 | 389 | 50.2 | fail | Comparative example |
| 27 | | 86 | 14 | 3 | 5 | 1.3 | 401 | 47.5 | pass | Example |
| 28 | H | 82 | 18 | 0 | 2 | 1.5 | 472 | 40.4 | pass | Example |
| 29 | | 74 | 26 | 2 | 1 | 1.4 | 511 | 36.7 | pass | Example |
| 30 | | 67 | 33 | 3 | 4 | 1.5 | 545 | 28.0 | fail | Comparative example |
| 31 | I | 81 | 11 | 18 | 3 | 1.9 | 426 | 43.2 | fail | Comparative example |
| 32 | | 82 | 14 | 13 | 5 | 0.4 | 440 | 41.7 | pass | Example |
| 33 | | 80 | 18 | 10 | 4 | 1.7 | 459 | 41.0 | pass | Example |
| 34 | J | 81 | 19 | 3 | 6 | 1.8 | 455 | 40.7 | pass | Example |
| 35 | | 73 | 27 | 0 | 4 | 1.8 | 492 | 37.8 | pass | Example |
| 36 | | 69 | 31 | 2 | 2 | 1.6 | 510 | 33.0 | fail | Comparative example |
| 37 | K | 81 | 4 | 17 | 0 | 1.3 | 575 | 27.5 | fail | Comparative example |
| 38 | | 84 | 7 | 14 | 0 | 1.5 | 551 | 32.3 | pass | Example |
| 39 | | 85 | 8 | 9 | 1 | 0.1 | 514 | 36.4 | pass | Example |
| 40 | L | 88 | 10 | 6 | 2 | 0.5 | 486 | 38.2 | pass | Example |
| 41 | | 76 | 24 | 4 | 2 | 0.3 | 423 | 46.4 | pass | Example |
| 42 | | 69 | 31 | 0 | 6 | 0.7 | 501 | 29.8 | fail | Comparative example |
| 43 | M | 94 | 4 | 1 | 5 | 0.6 | 325 | 58.3 | pass | Comparative example |
| 44 | N | 61 | 32 | 3 | 0 | 1.0 | 523 | 28.4 | fail | Comparative example |
| 45 | O | 56 | 31 | 5 | 1 | 1.6 | 553 | 27.4 | pass | Comparative example |
| 46 | P | 59 | 33 | 2 | 3 | 1.0 | 540 | 28.1 | pass | Comparative example |
| 47 | Q | 72 | 28 | 1 | 0 | 0.4 | 495 | 35.6 | fail | Comparative example |

The invention claimed is:

1. A steel sheet having a chemical composition comprising, by mass %:

C: 0.100% to 0.250%;

Si: 0.001% to 1.0%;

Mn: 0.75% or less;

P: 0.100% or less;

S: 0.0150% or less;

Al: 0.010% to 0.100%;

N: 0.0100% or less; and the balance being Fe and incidental impurities, wherein the steel sheet has a microstructure comprising, by area percentage, 50% or more of a ferrite phase, in a range of 5% to 30% of a pearlite phase, and 15% or less in total of bainite, martensite, and retained austenite, the area percentage of ferrite grains each containing three or more cementite grains having an aspect ratio of 1.5 or less is 30% or less, and a number of inclusions having a particle size of 10 μm or more present in a portion extending from a surface to a ¼ thickness position is 2.0 particles/$mm^2$ or less.

2. The steel sheet according to claim 1, wherein the chemical composition further comprises, by mass %, at least one element selected from the group consisting of Cr: 0.001% to 0.050%, V: 0.001% to 0.050%, Mo: 0.001% to 0.050%, Cu: 0.005% to 0.100%, Ni: 0.005% to 0.100%, and B: 0.0003% to 0.2000%.

3. The steel sheet according to claim 1, wherein the chemical composition further comprises, by mass %, at least one element selected from the group consisting of Ca: 0.0010% to 0.0050% and REM: 0.0010% to 0.0050%.

4. The steel sheet according to claim 1, wherein the steel sheet includes a coated layer on a surface thereof.

5. The steel sheet according to claim 4, wherein the coated layer is a hot-dip galvanized layer, a hot-dip galvannealed layer, or an electrogalvanized layer.

6. A method for producing a steel sheet, the method comprising:

hot-rolling a steel sheet having the chemical composition according to claim 1 under conditions that an average cooling rate after continuous casting is 0.5° C./s or more and a holding time in a temperature range of 1,150° C. or higher during a first holding is in a range of 2,000 to 3,000 seconds, and coiling at a coiling temperature of 600° C. or lower;

pickling the steel sheet after the hot-rolling step; and annealing the steel sheet after the pickling step to (Ac1+20°) C or higher under a condition that an average heating rate to 400° C. is 2.0° C./s or more, holding the steel sheet in a temperature range of (Ac1+20°) C or higher during a second holding for in a range of 10 seconds or more and 300 seconds or less, cooling the steel sheet to 550° C. or lower under a condition that an average cooling rate to 550° C. after the second holding is in a range of 10 to 200° C./s, holding the steel sheet in a temperature range in a range of 350° C. or higher and 550° C. or lower during a third holding for in a range of 30 to 800 seconds, and cooling the steel sheet under a condition that an average cooling rate is in a range of 2.0° C./s or more and 5.0° C./s or less in a temperature range to 200° C. after the third holding.

7. A method for producing a steel sheet, the method comprising:

hot-rolling a steel sheet having the chemical composition according to claim 1 under conditions that an average cooling rate after continuous casting is 0.5° C./s or more and a holding time in a temperature range of 1,150° C. or higher during a first holding is in a range of 2,000 to 3,000 seconds, and coiling at a coiling temperature of 600° C. or lower;

pickling the steel sheet after the hot-rolling step;

cold-rolling the steel sheet after the pickling step; and annealing the steel sheet after the cold-rolling step to (Ac1+20°) C or higher under a condition that an average heating rate to 400° C. is 2.0° C./s or more, holding the steel sheet in a temperature range of (Ac1+20°) C or higher during a second holding for in a range of 10 seconds or more and 300 seconds or less, cooling the steel sheet to 550° C. or lower under a condition that an average cooling rate to 550° C. after the second holding is in a range of 10 to 200° C./s, holding the steel sheet in a temperature range of 350° C. or higher and 550° C. or lower during a third holding for in a range of 30 to 800 seconds, and cooling the steel sheet under a condition that an average cooling rate is in a range of 2.0° C./s or more and 5.0° C./s or less in a temperature range to 200° C. after the third holding.

8. The method for producing a steel sheet according to claim 6, wherein after the third holding of the steel sheet in the temperature range of 350° C. or higher and 550° C. or lower for in the range of 30 to 800 seconds in the annealing step, the steel sheet is subjected to coating treatment.

9. The steel sheet according to claim 2, wherein the chemical composition further comprises, by mass %, at least one element selected from the group consisting of Ca: 0.0010% to 0.0050% and REM: 0.0010% to 0.0050%.

10. The steel sheet according to claim 2, wherein the steel sheet includes a coated layer on a surface thereof.

11. The steel sheet according to claim 3, wherein the steel sheet includes a coated layer on a surface thereof.

12. The steel sheet according to claim 9, wherein the steel sheet includes a coated layer on a surface thereof.

13. The steel sheet according to claim 10, wherein the coated layer is a hot-dip galvanized layer, a hot-dip galvannealed layer, or an electrogalvanized layer.

14. The steel sheet according to claim 11, wherein the coated layer is a hot-dip galvanized layer, a hot-dip galvannealed layer, or an electrogalvanized layer.

15. The steel sheet according to claim 12, wherein the coated layer is a hot-dip galvanized layer, a hot-dip galvannealed layer, or an electrogalvanized layer.

16. A method for producing a steel sheet, the method comprising:

hot-rolling a steel sheet having the chemical composition according to claim 2 under conditions that an average cooling rate after continuous casting is 0.5° C./s or more and a holding time in a temperature range of 1,150° C. or higher during a first holding is in a range of 2,000 to 3,000 seconds, and coiling at a coiling temperature of 600° C. or lower;

pickling the steel sheet after the hot-rolling step; and annealing the steel sheet after the pickling step to (Ac1+20°) C or higher under a condition that an average heating rate to 400° C. is 2.0° C./s or more, holding the steel sheet in a temperature range of (Ac1+20°) C or higher during a second holding for in a range of 10 seconds or more and 300 seconds or less, cooling the steel sheet to 550° C. or lower under a condition that an average cooling rate to 550° C. after the second holding is in a range of 10 to 200° C./s, holding the steel sheet in a temperature range in a range of 350° C. or higher and 550° C. or lower during a third holding for in a range of 30 to 800 seconds, and cooling the steel sheet under a condition that an average cooling rate is in a range of 2.0° C./s or more and 5.0° C./s or less in a temperature range to 200° C. after the third holding.

17. A method for producing a steel sheet, the method comprising:

hot-rolling a steel sheet having the chemical composition according to claim 3 under conditions that an average cooling rate after continuous casting is 0.5° C./s or more and a holding time in a temperature range of 1,150° C. or higher during a first holding is in a range of 2,000 to 3,000 seconds, and coiling at a coiling temperature of 600° C. or lower;

pickling the steel sheet after the hot-rolling step; and annealing the steel sheet after the pickling step to (Ac1+20°) C or higher under a condition that an average heating rate to 400° C. is 2.0° C./s or more, holding the steel sheet in a temperature range of (Ac1+20°) C or higher during a second holding for in a range of 10 seconds or more and 300 seconds or less, cooling the steel sheet to 550° C. or lower under a condition that an average cooling rate to 550° C. after the second holding is in a range of 10 to 200° C./s, holding the steel sheet in a temperature range in a range of 350° C. or higher and 550° C. or lower during a third holding for in a range of 30 to 800 seconds, and cooling the steel sheet under a condition that an average cooling rate is in a range of 2.0° C./s or more and 5.0° C./s or less in a temperature range to 200° C. after the third holding.

18. A method for producing a steel sheet, the method comprising:

hot-rolling a steel sheet having the chemical composition according to claim 2 under conditions that an average cooling rate after continuous casting is 0.5° C./s or more and a holding time in a temperature range of 1,150° C. or higher during a first holding is in a range of 2,000 to 3,000 seconds, and coiling at a coiling temperature of 600° C. or lower;

pickling the steel sheet after the hot-rolling step;

cold-rolling the steel sheet after the pickling step; and annealing the steel sheet after the cold-rolling step to (Ac1+20°) C or higher under a condition that an average heating rate to 400° C. is 2.0° C./s or more, holding the steel sheet in a temperature range of (Ac1+20°) C or higher during a second holding for in a range of 10 seconds or more and 300 seconds or less, cooling the steel sheet to 550° C. or lower under a condition that an average cooling rate to 550° C. after the second holding is in a range of 10 to 200° C./s, holding the steel sheet in a temperature range of 350° C. or higher and 550° C. or lower during a third holding for in a range of 30 to 800 seconds, and cooling the steel sheet under a condition that an average cooling rate is in a range of 2.0° C./s or more and 5.0° C./s or less in a temperature range to 200° C. after the third holding.

19. A method for producing a steel sheet, the method comprising:

hot-rolling a steel sheet having the chemical composition according to claim 3 under conditions that an average cooling rate after continuous casting is 0.5° C./s or more and a holding time in a temperature range of 1,150° C. or higher during a first holding is in a range of 2,000 to 3,000 seconds, and coiling at a coiling temperature of 600° C. or lower;

pickling the steel sheet after the hot-rolling step;

cold-rolling the steel sheet after the pickling step; and annealing the steel sheet after the cold-rolling step to (Ac1+20°) C or higher under a condition that an average heating rate to 400° C. is 2.0° C./s or more, holding the steel sheet in a temperature range of (Ac1+20°) C or higher during a second holding for in a range of 10 seconds or more and 300 seconds or less, cooling the steel sheet to 550° C. or lower under a condition that an average cooling rate to 550° C. after the second holding is in a range of 10 to 200° C./s, holding the steel sheet in a temperature range of 350° C. or higher and 550° C. or lower during a third holding for in a range of 30 to 800 seconds, and cooling the steel sheet under a condition that an average cooling rate is in a range of 2.0° C./s or more and 5.0° C./s or less in a temperature range to 200° C. after the third holding.

20. The method for producing a steel sheet according to claim 16, wherein after the third holding of the steel sheet in the temperature range of 350° C. or higher and 550° C. or lower for in the range of 30 to 800 seconds in the annealing step, the steel sheet is subjected to coating treatment.

21. The method for producing a steel sheet according to claim 17, wherein after the third holding of the steel sheet in the temperature range of 350° C. or higher and 550° C. or lower for in the range of 30 to 800 seconds in the annealing step, the steel sheet is subjected to coating treatment.

22. The method for producing a steel sheet according to claim 18, wherein after the third holding of the steel sheet in the temperature range of 350° C. or higher and 550° C. or lower for in the range of 30 to 800 seconds in the annealing step, the steel sheet is subjected to coating treatment.

23. The method for producing a steel sheet according to claim 19, wherein after the third holding of the steel sheet in the temperature range of 350° C. or higher and 550° C. or lower for in the range of 30 to 800 seconds in the annealing step, the steel sheet is subjected to coating treatment.

24. The method for producing a steel sheet according to claim 7, wherein after the third holding of the steel sheet in the temperature range of 350° C. or higher and 550° C. or lower for in the range of 30 to 800 seconds in the annealing step, the steel sheet is subjected to coating treatment.

25. A method for producing a steel sheet, the method comprising:

hot-rolling a steel sheet having the chemical composition according to claim 9 under conditions that an average cooling rate after continuous casting is 0.5 ° C/s or more and a holding time in a temperature range of 1,150 ° C. or higher during a first holding is in a range of 2,000 to 3,000 seconds, and coiling at a coiling temperature of 600 ° C. or lower;

pickling the steel sheet after the hot-rolling step; and annealing the steel sheet after the pickling step to (Acl+20)° C. or higher under a condition that an average heating rate to 400 ° C. is 2.0 ° C/s or more, holding the steel sheet in a temperature range of (Acl+20) ° C. or higher during a second holding for in a range of 10 seconds or more and 300 seconds or less, cooling the steel sheet to 550 ° C. or lower under a condition that an average cooling rate to 550 ° C. after the second holding is in a range of 10 to 200 ° C/s, holding the steel sheet in a temperature range in a range of 350 ° C. or higher and 550 ° C. or lower during a third holding for in a range of 30 to 800 seconds, and cooling the steel sheet under a condition that an average cooling rate is in a range of 2.0 ° C/s or more and 5.0 ° C/s or less in a temperature range to 200 ° C. after the third holding.

26. A method for producing a steel sheet, the method comprising:

hot-rolling a steel sheet having the chemical composition according to claim 9 under conditions that an average cooling rate after continuous casting is 0.5 ° C/s or more and a holding time in a temperature range of 1,150 ° C. or higher during a first holding is in a range of 2,000 to 3,000 seconds, and coiling at a coiling temperature of 600 ° C. or lower;

pickling the steel sheet after the hot-rolling step;

cold-rolling the steel sheet after the pickling step; and annealing the steel sheet after the cold-rolling step to (Acl+20) ° C. or higher under a condition that an average heating rate to 400 ° C. is 2.0 ° C/s or more, holding the steel sheet in a temperature range of (Acl+20) ° C. or higher during a second holding for in a range of 10 seconds or more and 300 seconds or less, cooling the steel sheet to 550 ° C. or lower under a condition that an average cooling rate to 550 ° C. after the second holding is in a range of 10 to 200 ° C/s, holding the steel sheet in a temperature range of 350 ° C. or higher and 550° C. or lower during a third holding for in a range of 30 to 800 seconds, and cooling the steel sheet under a condition that an average cooling rate is in a range of 2.0 ° C/s or more and 5.0 ° C/s or less in a temperature range to 200 ° C. after the third holding.

27. The method for producing a steel sheet according to claim 25, wherein after the third holding of the steel sheet in the temperature range of 350 ° C. or higher and 550 ° C. or lower for in the range of 30 to 800 seconds in the annealing step, the steel sheet is subjected to coating treatment.

28. The method for producing a steel sheet according to claim 26, wherein after the third holding of the steel sheet in the temperature range of 350 ° C. or higher and 550 ° C. or lower for in the range of 30 to 800 seconds in the annealing step, the steel sheet is subjected to coating treatment.

* * * * *